United States Patent [19]

Shimura et al.

[11] Patent Number: 4,752,558

[45] Date of Patent: Jun. 21, 1988

[54] LIGHT-SENSITIVE SILVER HALIDE COLOR PHOTOGRAPHIC MATERIAL

[75] Inventors: Shinya Shimura; Yoshitaka Yamada; Toshifumi Iijima; Kenji Kumashiro; Takashi Kamio, all of Hino, Japan

[73] Assignee: Konishiroku Photo Industry Co., Ltd., Tokyo, Japan

[21] Appl. No.: 933,294

[22] Filed: Nov. 20, 1986

Related U.S. Application Data

[63] Continuation of Ser. No. 589,878, Mar. 15, 1984, abandoned.

[30] Foreign Application Priority Data

Mar. 31, 1983 [JP] Japan ..... 58-55649
Apr. 1, 1983 [JP] Japan ..... 58-57452

[51] Int. Cl.[4] ..... G03C 1/08; G03C 1/46

[52] U.S. Cl. ..... 430/505; 430/506; 430/509

[58] Field of Search ..... 430/506, 509, 505

[56] References Cited

U.S. PATENT DOCUMENTS

| | | | |
|---|---|---|---|
| 2,258,187 | 10/1941 | Mannes et al. | 430/509 X |
| 3,402,046 | 9/1963 | Zwick | 430/509 X |
| 3,658,536 | 4/1972 | Wolf | 430/506 |
| 3,849,138 | 11/1974 | Wyckoff | 430/506 |
| 4,129,446 | 12/1978 | Lohmann et al. | 430/506 |
| 4,138,258 | 2/1979 | Hirose et al. | 430/505 |
| 4,184,876 | 1/1980 | Eeles et al. | 430/505 |
| 4,273,861 | 6/1981 | Shiba et al. | 430/505 X |
| 4,347,301 | 8/1982 | Kliem | 430/505 X |
| 4,427,763 | 1/1984 | Lohmann et al. | 430/506 X |

*Primary Examiner*—Mukund J. Shah
*Attorney, Agent, or Firm*—Frishauf, Holtz, Goodman & Woodward

[57] ABSTRACT

Disclosed is a light-sensitive silver halide photographic material comprising at least one layer of green-sensitive silver halide emulsion layer (GH), at least one layer of red-sensitive silver halide emulsion layer (RH) and a plural number of blue-sensitive silver halide emulsion layers with different sensitivities, provided on a support, which is characterized in that one of the said plural number of blue-sensitive silver halide emulsion layers is provided as a silver halide emulsion layer (BH) positioned at the farthest side from the support, at least one layer GH and at least one layer RH are provided between the layer BH and a blue-sensitive silver halide emulsion layer lower in sensitivity than the layer BH, and further fine grains of silver halide are contained in at least one of the said blue-sensitive emulsion layer of lower sensitivity and a layer adjacent thereto. The fine grains of silver halide may have a blue-sensitive sensitizing dye adsorbed on the surfaces thereof.

14 Claims, No Drawings

LIGHT-SENSITIVE SILVER HALIDE COLOR PHOTOGRAPHIC MATERIAL

This application is a continuation of application Ser. No. 589,878, filed Mar. 15, 1984, now abandoned.

BACKGROUND OF THE INVENTION

This invention relates to a light-sensitive silver halide color photographic material. More particularly, the present invention relates to a light-sensitive silver halide color photographic material which is high in sensitivity and can also exhibit excellent graininess.

Heretofore, it has been desired to develop a light-sensitive silver halide color photographic material (hereinafter abbreviated as "light-sensitive material") which is high in sensitivity and excellent in image quality. Particularly, in recent years, as the increase of chances of photographing under bad conditions with small quantity of light such as indoors and also with the progress of small formatting of light-sensitive materials, it has been strongly desired to develop a light-sensitive material which is high in sensitivity and excellent in image quality such as sharpness, graininess and interimage effect.

However, it is difficult to effect both higher sensitization and improvement of image quality.

For example, as the layer constitution for higher sensitization, the following consistution has been known. That is,. in a layer constitution of regular sequence having respective layers of red-sensitive, green-sensitive and blue-sensitive light-sensitive silver halide emulsion layers (light-sensitive silver halide emulsion layer is hereinafter referred to merely as "emulsion layer") provided by coating on a support, a part or whole of the light-sensitive emulsion layers are separated into a high sensitivity silver halide emulsion layer (hereinafter referred to as high sensitivity emulsion layer) and a low sensitivity silver halide emulsion layer (hereinafter referred to as low sensitivity emulsion layer), each containing a diffusion resistant coupler capable of color forming to substantially the same hue, and these layers are laminated adjacent to each other.

According to such a constitution, there is the problem that the emulsion layer on the side nearer to the support will suffer from decreased dosage of light on exposure of light because of absorption by other emulsion layers positioned on the side farther from the support. Moreover, during development, a considerably long time is required for diffusion of a developer.

Thus, according to such a layer constitution of regular sequence, due to loss in dosage of exposure and retardation in development, it is difficult to achieve higher sensitization in green-sensitive and red-sensitive emulsion layers positioned as lower layers (nearer to the support side).

On the other hand, techniques to alter the order of respective emulsion layers laminated are known.

For example, U.S. Pat. No. 3,663,228 discloses a constitution comprising:

(a) the respective low sensitivity emulsion layers of red-sensitive, green-sensitive and blue-sensitive layers provided by coating on a support in the order mentioned from the support side; and (b) the respective high sensitivity emulsion layers of red-sensitive, green-sensitive and blue-sensitive layers provided by coating on the side farther from the support in the order mentioned from the support side.

This technique can afford higher sensitivity as compared with the constitution of regular sequence as described above. However, as can clearly be seen from the fact that each unit of laminates of the aforesaid high sensitivity emulsion layer and low sensitivity emulsion layer are separated by ND (neutral density) filter, higher sensitization is not to the fore of interest at all.

Next, U.S. Pat. No. 3,658,536 discloses a technique to cancel loss of dosage in a green-sensitive emulsion layer having great effect on visual sensitivity by positioning the green-sensitive emulsion layer on the surface side farther from the support.

However, according to such a layer constitution, high sensitization technique of a blue-sensitive emulsion layer is not dealt with at all, and also improvement of sharpness graininess and interimage effect is not satisfactory.

Otherwise, there have also been known techniques concerning alteration of the layer constitution as disclosed in Japanese Unexamined Patent Publications Nos. 49027/1976 and 97424/1978 and U.S. Pat. No. 4,129,446.

However, any of these techniques, while higher in sensitivity than the layer constitution of regular sequence as described above, is not only unsatisfactory in sensitivity of green-sensitive and red-sensitive emulsion layers but also unsatisfactory in effects of improvement of image quality such as graininess and sharpness.

SUMMARY OF THE INVENTION

Primary objects of this invention are to provide a highly sensitized light-sensitive material and also to provide a light-sensitive material which can give images of high quality (good graininess and preferably also sufficient sharpness). More specifically, an object of this invention is to provide a light-sensitive silver halide photographic material, in the case of a layer constitution comprising respective high sensitivity layers with different color sensitivities provided on respective low sensitivity layers with different color sensitivities, wherein the sensitivity of Dmin+ (0.4–0.8) is improved to improve linearity of gradation simultaneously with improvement of graininess, preferably also improvement of sharpness.

Such an object can be accomplished by this invention as defined below.

That is, this invention provides a light-sensitive silver halide photographic material comprising at least one layer of green-sensitive silver halide emulsion layer, at least one layer of red-sensitive silver halide emulsion layer and a plural number of blue-sensitive silver halide emulsion layers with different sensitivities, provided on a support, wherein one of the said plural number of blue-sensitive silver halide emulsion layers is provided as a silver halide emulsion layer positioned at the side farthest from the support, at least one layer of green-sensitive silver halide emulsion and at least one layer of red-sensitive silver halide emulsion are provided between the said blue-sensitive silver halide emulsion layer and a blue-sensitive silver halide emulsion layer lower in sensitivity than the said blue-sensitive silver halide emulsion layer, and further fine grains of a silver halide are contained in at least one of said blue-sensitive emulsion layer of lower sensitivity and a layer adjacent thereto.

According to a preferred embodiment of this invention, the fine grains of a silver halide may have a blue-sensitive sensitizing dye adsorbed on the surfaces thereof.

DESCRIPTION OF THE PREFERRED EMBODIMENTS

The light-sensitive silver halide material (sensitive material) has a plural number of blue-sensitive silver halide emulsion layers with different sensitivities.

One of the blue-sensitive silver halide emulsion layers is provided on the side farthest from the support among all the silver halide emulsion layers. The blue-sensitive layer on the uppermost side may be divided into two layers.

On the other hand, the sensitive material of this invention has each of at least one layer of green-sensitive and red-sensitive emulsion layers, respectively. Moreover, each of at least one layer of the green-sensitive and red-sensitive layers is provided beneath the above-mentioned blue-sensitive layer on the uppermost side (on the support side).

Further, beneath each of at least one layer of the green-sensitive and red-sensitive layers (i.e., on the support side), a blue-sensitive silver halide emulsion layer lower in sensitivity than the above-mentioned blue-sensitive layer on the uppermost side is provided. This lower sensitivity blue-sensitive layer may be also divided into two layers.

In this case, the blue-sensitive layer on the uppermost side may have a difference in sensitivity from the lower sensitivity blue-sensitive layer, preferably of $\Delta$ log E=0.2 to 1.0.

Each of the green-sensitive layer and the red-sensitive layer thus interposed between the uppermost blue-sensitive layer and the lower sensitivity blue-sensitive layer may be divided into two layers.

In this case, the green-sensitive layer may preferably be positioned on the side farther from the support (upper layer) that the red-sensitive layer. This is because the green-sensitive layer has a color sensitivity to the wavelength region having greater effect on visual sensitivity and the influence from light scattering can be minimized by positioning such a layer to the upper layer.

On the other hand, it is preferred to provide each of at least one layer of green-sensitive and/or red-sensitive layers on the support side (lower than) of the above lower sensitivity blue-sensitive layer. Each of such green-sensitive and red-sensitive layers is made to have a lower sensitivity than that of the green-sensitive and red-sensitive layers interposed between the above uppermost blue-sensitive layer and the lower sensitivity blue-sensitive layer, with the difference in sensitivity between both being about $\Delta$ log E=0.2 to 1.0.

It is preferred to provide both of such lower sensitivity green-sensitive and red-sensitive layers, and the green-sensitive layer may preferably be positioned farther from the support side (upper layer) than the red-sensitive layer from the standpoint of sharpness.

Each of such lower sensitivity green-sensitive and red-sensitive layers may also be divided into two layers.

Further, in the case of dividing the above lower sensitivity blue-sensitive layer into two or more layers, the blue-sensitive layer of lower sensitivity may be positioned on the support side, and it is also possible to interpose low sensitivity green-sensitive and/or red-sensitive layers between the two blue-sensitive emulsion layers. Alternatively, it is further possible to provide green-sensitive and/or red-sensitive layers of lower sensitivity beneath the blue-sensitivity layer of lower sensitivity.

In the following, most preferred embodiments of layer constitution in this invention are shown, but this invention is not limited thereto. In the embodiments shown below, B indicates blue-sensitive layer, G green-sensitive layer and R red-sensitive layer; H and H' affixed to B, G and R indicate higher sensitivity and L and L' lower sensitivity, H being higher than H', and L being higher than L'. And, in the following, the orders of provision from the support are shown.

| Example: | A | B | C | D | E | F |
|---|---|---|---|---|---|---|
| Upper layer | BH | BH | BH | BH | BH | BH |
| | GH | GH | RH | GH | GH | GH |
| ↑ | RH | GH' | GH | RH | RH | RH |
| ↑ | BL | RH | BL | BL | GH' | BL |
| ↑ | GL | BL | GL | GL | RH' | GL |
| ↑ | RL | GL | RL | GL' | BL | RL |
| | Support | RL | Support | RL | GL' | BL' |
| | | Support | | Support | RL' | GL' |
| | | | | | Support | RL' |
| | | | | | | Support |

In such cases, it is preferred to interpose a non-light-sensitive intermediate layer between the layers with different color sensitivities adjacent to each other.

Also, it is possible to incorporate a scavenger substance which can react with and deactivate the oxidized product of a developing agent in such a non-light-sensitive intermediate layer.

The silver halide in such respective layers may have a composition, which is preferably silver iodobromide or silver bromide. It may otherwise be silver chlorobromide, silver chloroiodobromide and the like.

As to the grain sizes of the silver halide grains in the emulsion, in each of the high sensitivity layers, it is preferred to avoid presence of small grains with great light scattering for the purpose of minimizing deterioration in sharpness in the layers positioned on the support side.

For this purpose, the silver halide grains in each high sensitivity layer may have a mean grain size of 0.5 to 2.5$\mu$, particularly 0.7 to 2.5$\mu$. And, when the high sensitivity layer is divided into two layers, the layer with higher sensitivity may contain grains with sizes of about 0.7 to 2.5$\mu$, while the other layer with sizes of about 0.5 to 1.5$\mu$.

Whereas, the silver halide grains in each lower sensitivity layer should preferably have a mean grain size of 0.2 to 1.5$\mu$, particularly 0.2 to 1.0$\mu$. In this case, when a lower sensitivity layer is divided into two layers, one should contain grains with a mean grain size of about 0.5 to 1.5μ, while the other with a mean grain size of about 0.2 to 1.0μ.

Such silver halide grains may be either mono-dispersed or poly-dispersed, but preferably mono-dispersed from the aspect of improvement of sensitivity, graininess and sharpness.

In this case, when the mean grain size is represented by $\bar{r}$ and the standard deviation of the grain size distribution by $\sigma$, the mono-dispersed emulsion should preferably have a coefficient of fluctuation $\sigma/\bar{r}$ of 0.2 or less.

The silver halide grains in the emulsion layer having these color sensitivitied may have crystalline structures, which are not particularly limited, and the so-called core-shell type as well as other types may be available.

The emulsion layers having these color sensitivities may be prepared according to the methods which are not particularly limited, and any desired known method may be applicable. The protective colloid employed may also be any desired one such as gelatin and the like.

Such emulsions in the emulsion layers having respective color sensitivities may be chemically sensitized according to any desired known method.

The silver halide may be optically sensitized to a desired wavelength region with the use of a cyanine dye or a merocyanine dye to be endowed with a desired color sensitivity.

It is also preferable to incorporate couplers corresponding to the color sensitivities in the emulsion layer having respective color sensitivities. The couplers corresponding to color sensitivities may be combined according to known methods, and any desired known coupler may be available.

The silver to be coated in the emulsion layer is used in an amount of 4 to 40 mg/dm$^2$. The amount of a coupler used is about 0.01 to 0.4 mole per one mole of the silver halide.

An intermediate layer may be interposed between emulsion layers with different color sensitivities for prevention of color turbidity, and consist of a hydrophilic binder such as gelatin as described above, which may also optionally contain a scavenger or other substances.

Under the requisite conditions as described above, the specifically selected layers among the respective constituent layers as mentioned above contains fine grains of a silver halide.

In this invention, the layers in which fine grains of a silver halide are contained are at least one of the blue-sensitive layer of lower sensitivity provided as the further lower layer beneath the green-sensitive layer and the red-sensitive layer positioned as the lower layers beneath the blue-sensitive layer positioned on the farthest side from the support, and the layers adjacent thereto.

In this case, when they are contained in the blue-sensitive layer of lower sensitivity, which is divided into two or more layers, they may be contained in one layer or all layers, irrespective of whether these layers may be divided adjacent to each other. However, when separated through an intermediary layer having another color sensitivity, fine grains of a silver halide should preferably be contained at least in the layer positioned on the lower layer side (on the support side).

On the other hand, in place of, or in addition to such a constitution, when fine grains of a silver halide are contained in layers adjacent to the blue-sensitive layer of lower sensitivity, the adjacent layers refer to the layers including those up to or down to the second layer next to the blue-sensitive emulsion layer of lower sensitivity. In this case, when the blue-sensitive layer of lower sensitivity is divided by separation with another layer, either one of the layers, preferably the blue-sensitive layer positioned on the upper layer side, should preferably contain fine grains of a silver halide.

Particularly in such a case, the adjacent layer may preferably be an intermediate layer adjacent to and upper from (on the opposite side to the support) the blue-sensitive layer of lower sensitivity or an intermediate layer or a lower sensitivity green-sensitive layer or lower sensitive red-sensitive layer positioned as the first layer or the second layer beneath (on the support side) the blue-sensitive layer of lower sensitivity.

Of these constitutions, particularly preferred is a constitution in which fine grains of a silver halide are contained in at least one of the blue-sensitive layer of lower sensitivity and the intermediate layer adjacent below thereto, and further, if necessary, in at least one of the intermediate layer adjacent to and upper from the blue-sensitive layer of lower sensitivity and the lower sensitive green-sensitive layer or the lower sensitive red-sensitive layer positioned below the blue-sensitive layer of lower sensitivity.

The fine grains of a silver halide to be contained may have a mean grain size of 0.2μ or less, more preferably 0.03 to 0.15μ.

The fine grains of a silver halide may be contained in the emulsion layers having color sensitivities and/or the intermediate layer generally in an amount of 2 to 20 mg/dm$^2$, particularly 3 to 10 mg/dm$^2$ as the silver quantity to be coated.

The fine grains of a silver halide should preferably be substantially non-light-sensitive.

Such fine grains of a silver halide may be either poly-dispersed or mono-dispersed, particularly preferably mono-dispersed with a coefficient of fluctuation of 0.2 or less.

These may be prepared according to a known method and coated as a mixture with the emulsion to be used in the layer in which they are to be incorporated.

The fine grains of a silver halide may preferably be of silver bromide or silver iodobromide, particularly a silver iodobromide with a silver iodide content of 4 mole % or more.

According to a preferred embodiment of the present invention, such fine grains of a silver halide may have a blue-sensitive sensitizing dye adsorbed on the surfaces thereof.

As the blue-sensitive sesitizing dyes, there may be employed any of cyanine type, merocyanine type, hemicyanine type, styryl type, complex merocyanine type dyes or others.

The sensitizing dye is blue-sensitive and has a maximum absorption wavelength at 420 to 530 nm, preferably 450 to 500 nm.

As such blue-sensitive sensitizing dyes, those represented by the following formulae [I] to [III] are preferred.

Formula [I]

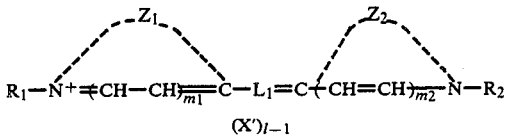

Formula [II]

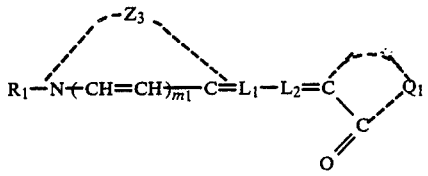

Formula [III]

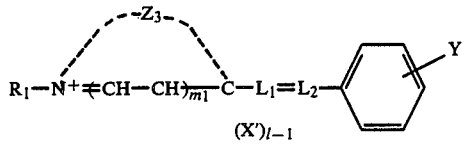

In the above formula [I] to [III], each of $R_1$, and $R_2$ and $R_3$ represents an alkyl group, a substituted alkyl group or an aryl group; each of $L_1$ and $L_2$ represents a methynyl group or a substituted methynyl group;

each of $Z_1$, $Z_2$ and $Z_3$ represents an atom or a group of atoms necessary for completion of a hetero ring such as thiazoline, oxazoline, selenazoline, thiazole, oxazole, selenazole, benzoimidazole, indolenine, thienothiazole, thiadiazole, oxadiazole, pyridine, quinoline and the like, of which aromatic ring may be fused;

$Q_1$ represents a group of atoms necessary for formation of a ring such as oxazolone, isooxazolone, pyrazolone, oxyindole, barbitur, thiobarbitur, oxazolidinedione, thiazolidinedione, imidazolidinedione, thiooxazolidinedione, thiothiazolidinedione, thioselenazolidinedione, thiohydantoin, oxazolinone, thiazolinone, imidazolinone and the like;

Y represents a hydrogen atom, an amino group, a substituted amino group, a halogen, an alkoxy group or an alkyl group;

$m_1$ and $m_2$ are each 0 or 1, $m_1+m_2$ being 0 or 1; and X is an acid anion group.

Specific examples of such blue-sensitive sensitizing dyes are set forth below, but this invention is not limited thereto.

BD1

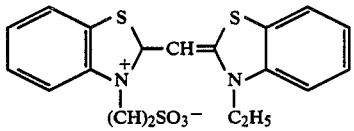

-continued

BD2

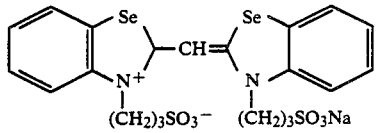

BD3

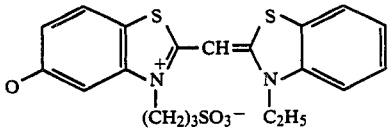

BD4

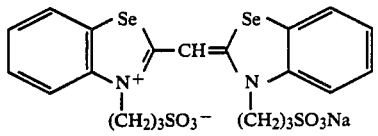

BD5

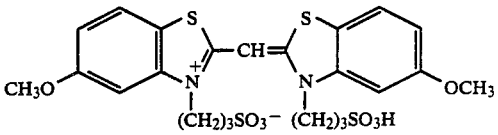

BD6

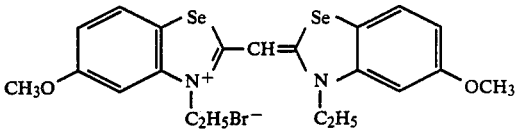

BD7

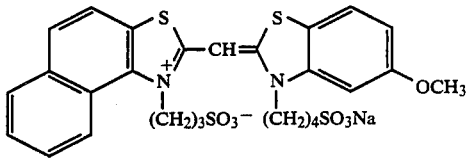

BD8

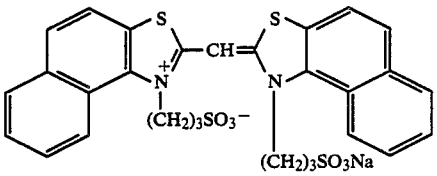

BD9

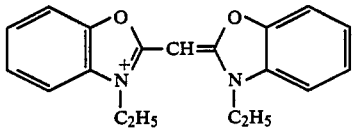

BD10

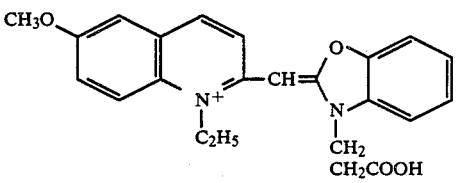

-continued
BD11
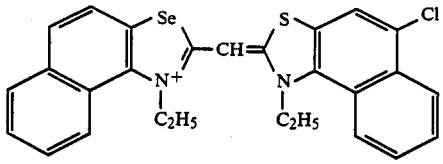
$CH_3SO_3^-$
BD12
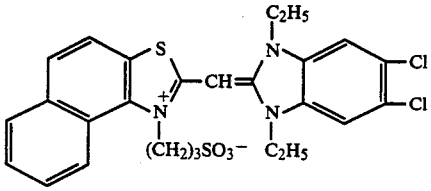
BD13
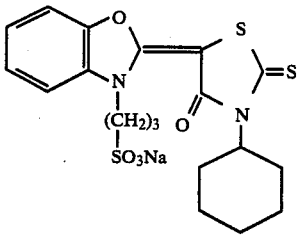
BD14
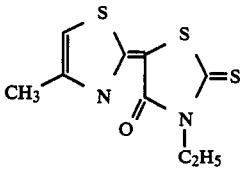
BD15
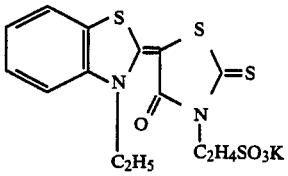
BD16
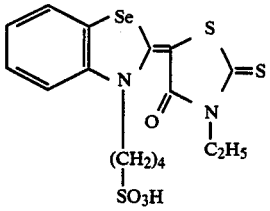
BD17
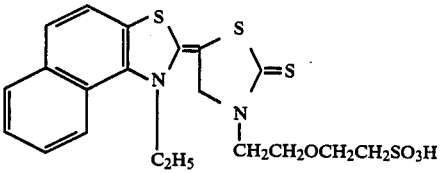
BD18
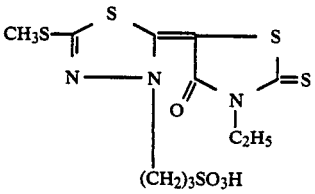
-continued
BD19
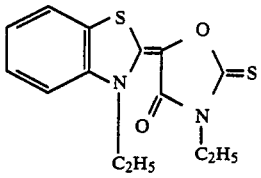
BD20
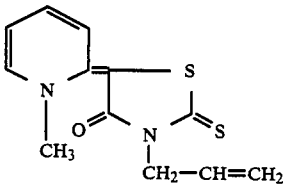
BD21
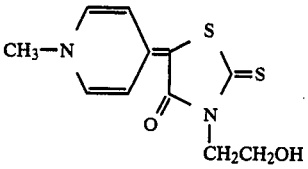
BD22
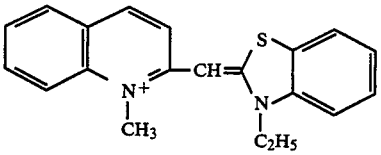
$Br^-$
BD23
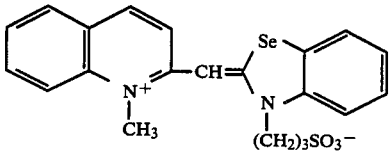
BD24
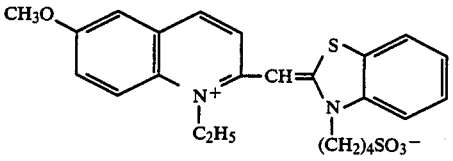
BD25
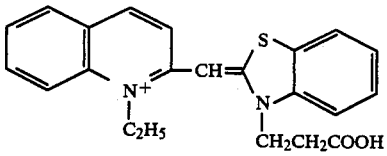
$Br^-$
BD26
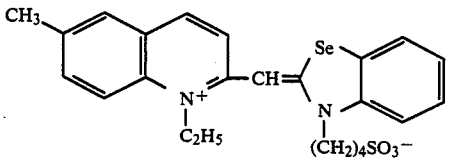

-continued

BD27

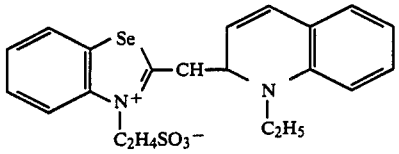

BD28

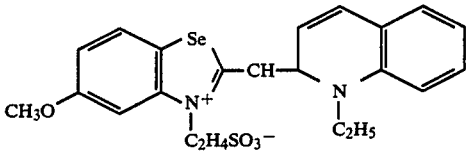

BD29

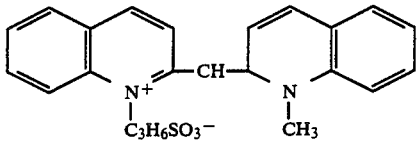

Such a blue-sensitive sensitizing dye may be adsorbed in an amount of about 100 to 500 mg per one mole of the fine grains of a silver halide.

The light-sensitive material of this invention is useful for various uses, particularly for color nega films.

To describe in more detail about the light-sensitive material of this invention, conventional colored magenta couplers may be used in the green-sensitive emulsion layer of this invention. As the colored magenta couplers, those disclosed in U.S. Pat. Nos. 2,801,171 and 3,519,429 and Japanese Patent Publication No. 27930/1973 may be available.

Particularly preferable colored magenta couplers are set forth below.

Japanese Patent Publication No. 32461/1980 and U.K. Pat. No. 1084480 may be available.

Particularly preferable colored cyan couplers are set forth below.

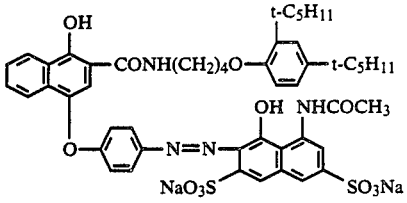

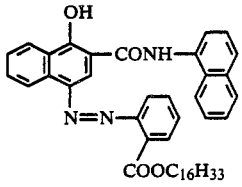

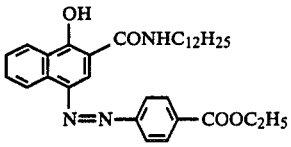

In the light-sensitive emulsion layers constituting the light-sensitive material of this invention, corresponding chromogenic couplers may be contained, respectively.

As the yellow chromogenic couplers, known closed-chain ketomethylene type couplers may be available. Among them, benzoylacetanilide type and pivaloylacetanilide type compounds may advantageously be used.

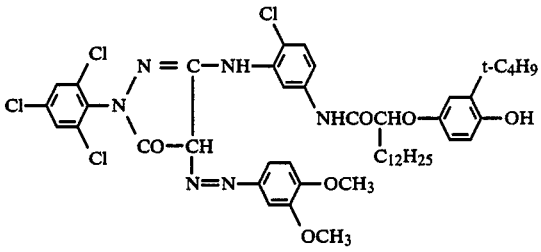

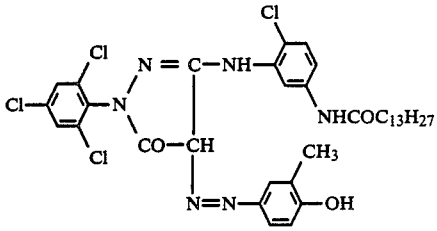

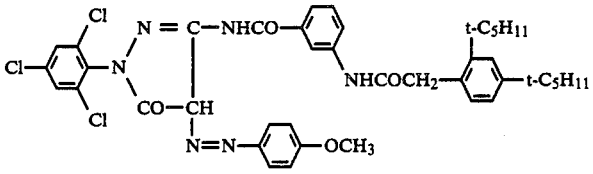

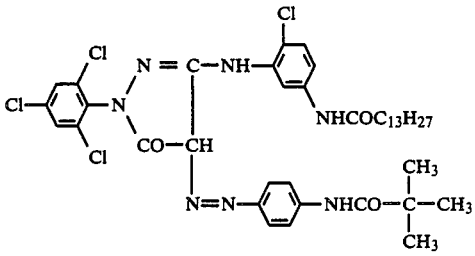

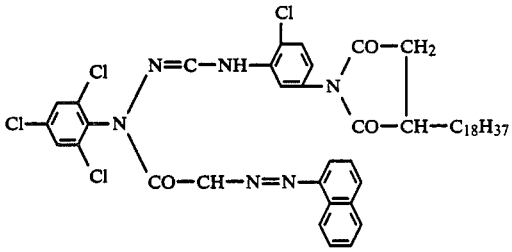

Also, conventional colored cyan couplers may be used in the red-sensitive emulsion layer of this invention. As the colored cyan couplers, those disclosed in Examples of yellow chromogenic couplers are disclosed in Japanese Unexamined Patent Publications Nos. 26133/1972, 29432/1973, 87650/1975, 17438/1976 and 102636/1976, Japanese Patent Publication No. 19956/1970, U.S. Pat. Nos. 2,875,057, 3,408,194 and 3,519,429, Japanese Patent Publications Nos. 33410/1976, 10783/1976 and 19031/1971.
Particularly preferable couplers are shown below.
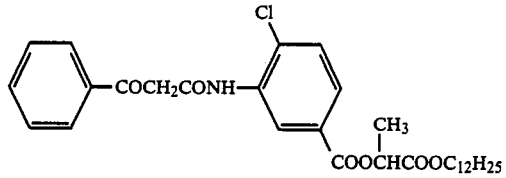
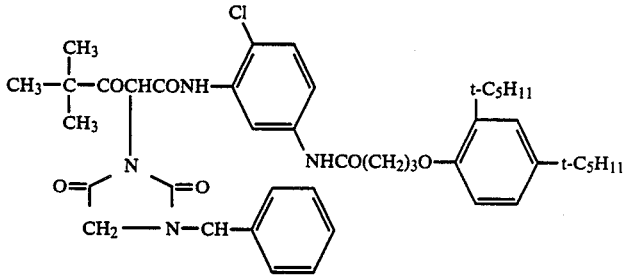
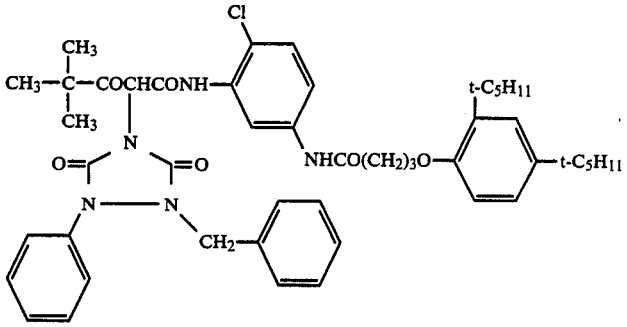
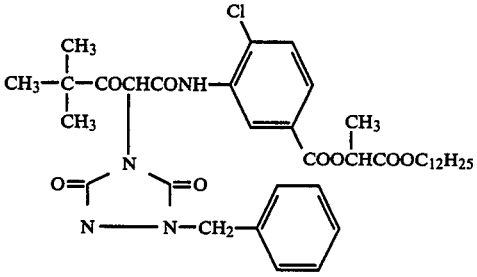
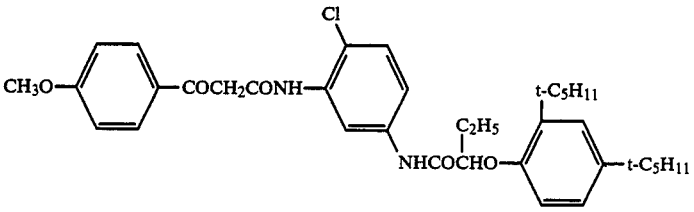
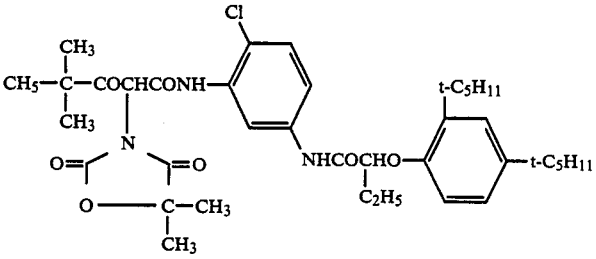

-continued
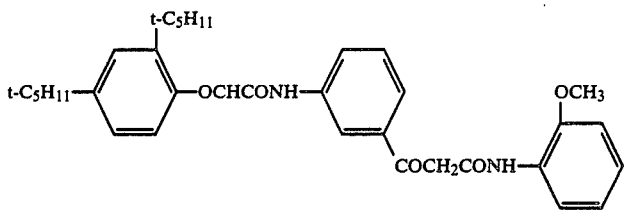
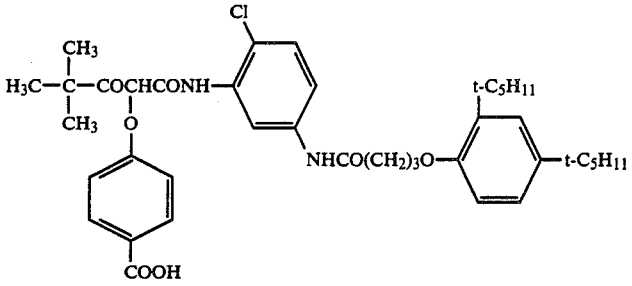
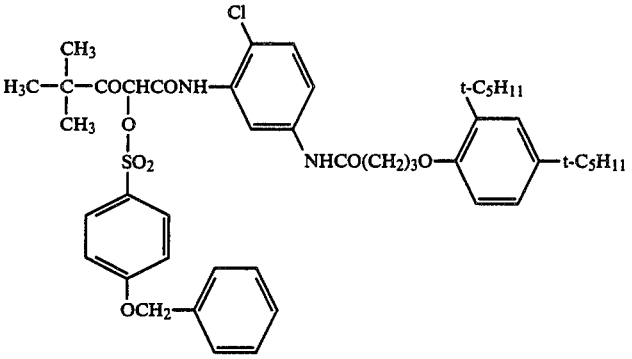
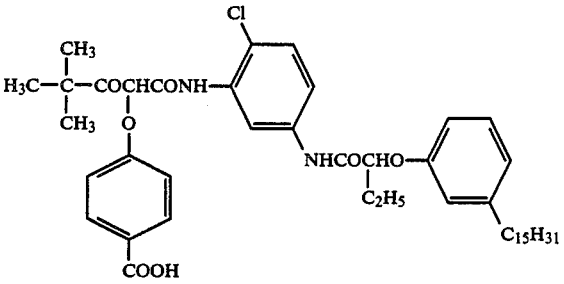
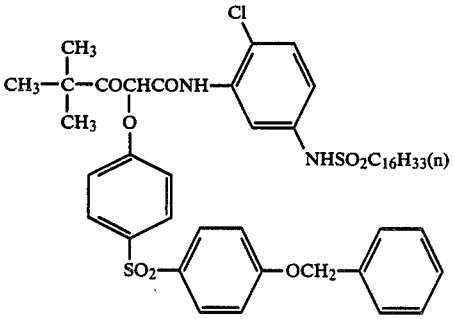

-continued

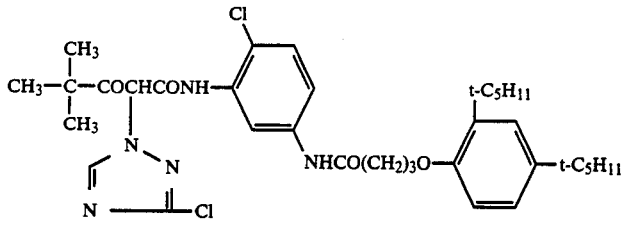

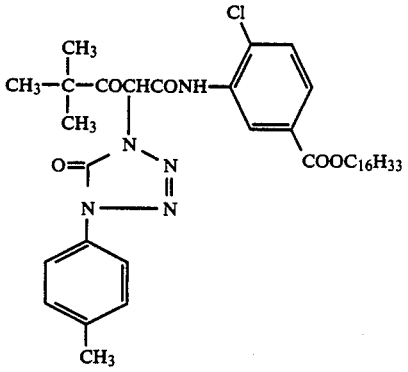

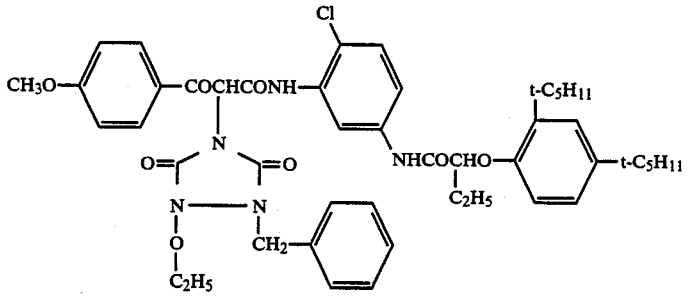

As the magenta chromogenic couplers, there may be employed pyrazolone type compounds, indazolone type compounds, cyanoacetyl compounds and pyrazolotriazole compounds, etc. Particularly, pyrazolone type compounds may advantageously be used.

Specific examples available are disclosed in Japanese Unexamined Patent Publication No. 111631/1974, Japanese Patent Publication No. 27930/1973, Japanese Unexamined Patent Publication No. 29236/1981, U.S. Pat. Nos. 2,600,788, 3,062,653, 3,408,194, 3,519,429, Japanese Unexamined Patent Publication No. 94752/1982 and Research Disclosure-12443.

Particularly preferable couplers are shown below.

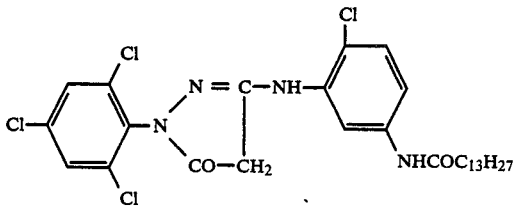

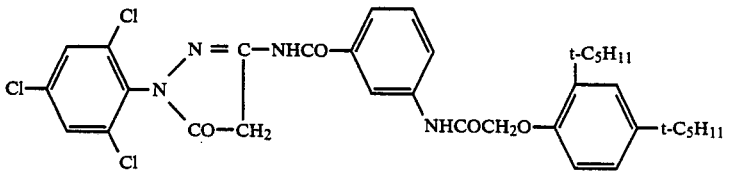

-continued
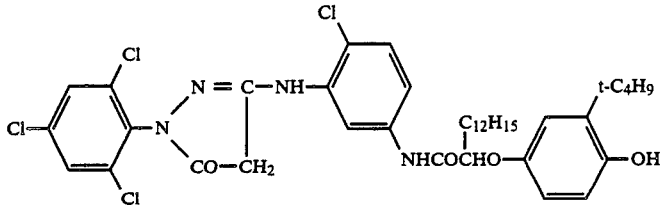
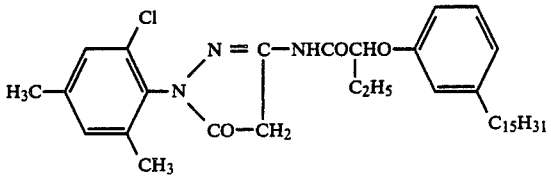
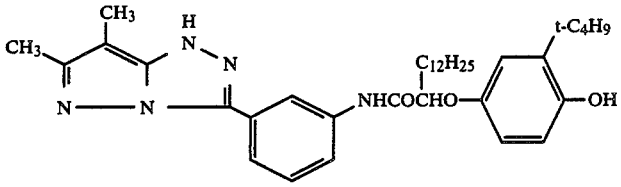
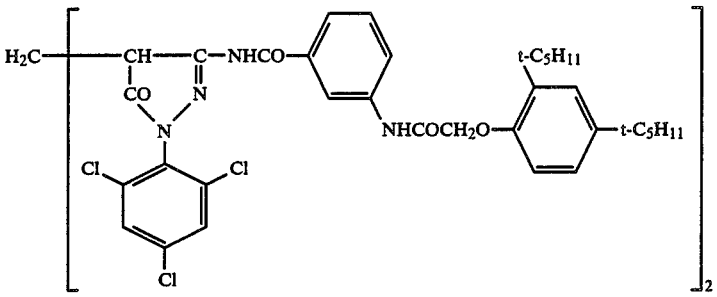
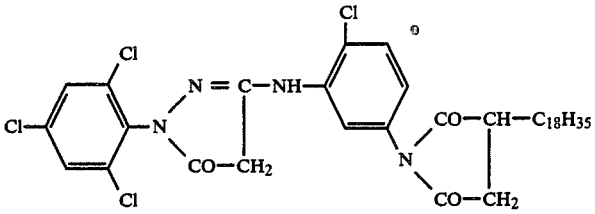
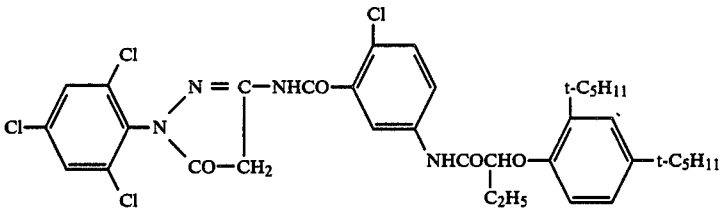
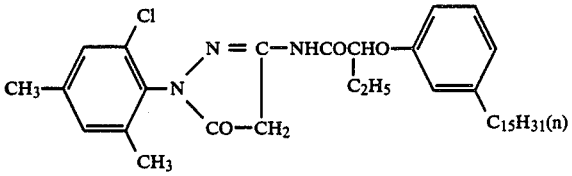

-continued
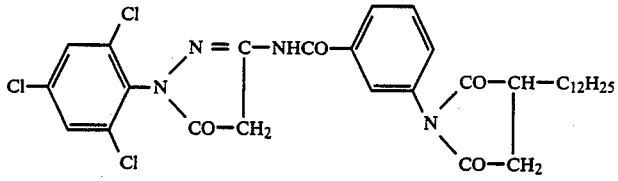
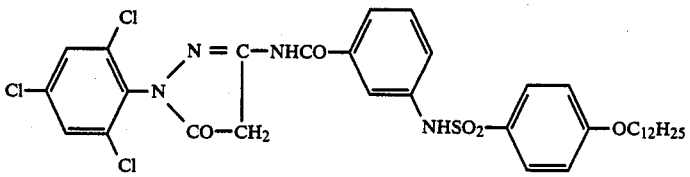
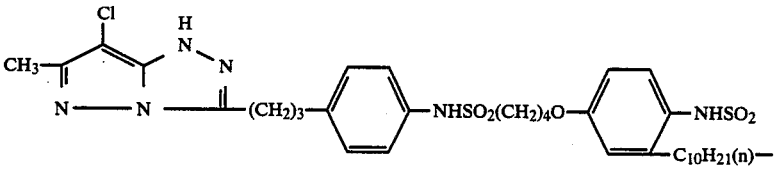
As cyan chromogenic couplers, phenol type compounds and naphthol type compounds can be used.
Specific examples are disclosed in U.S. Pat. Nos. 2,423,730, 2,474,293 and 2,895,826 and Japanese Unexamined Patent Publication No. 117422/1975.
Particularly preferably couplers are shown below.
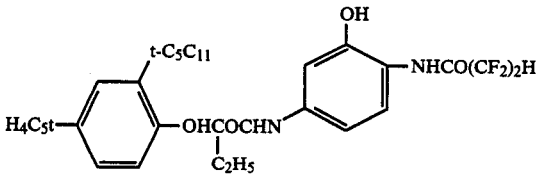
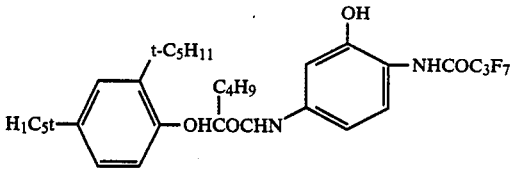
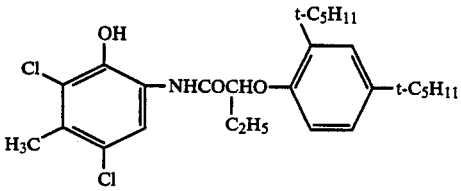
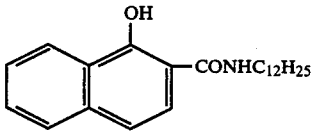
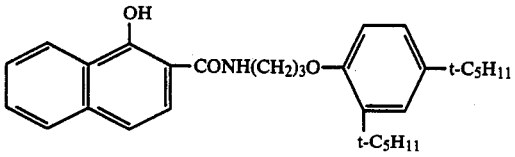
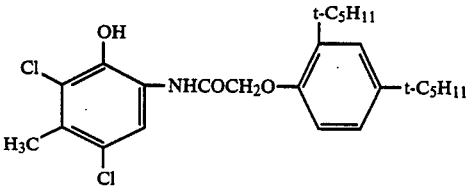
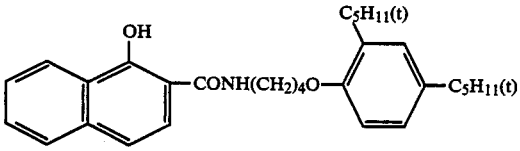
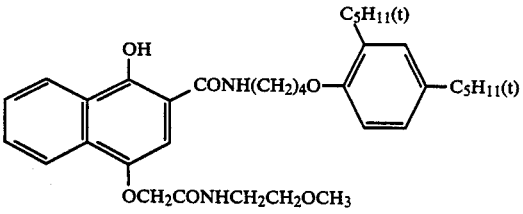

-continued

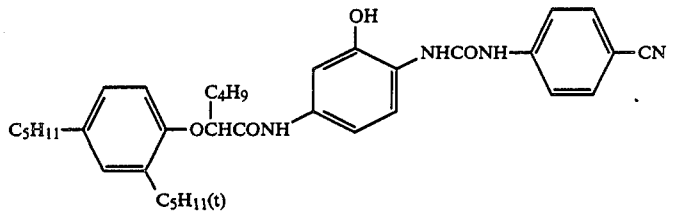

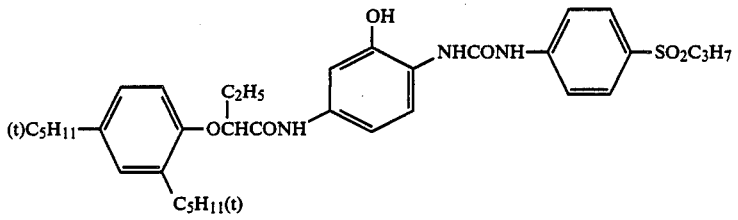

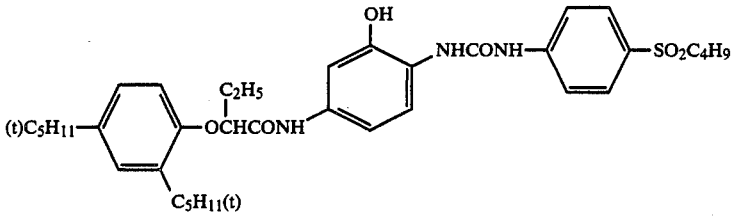

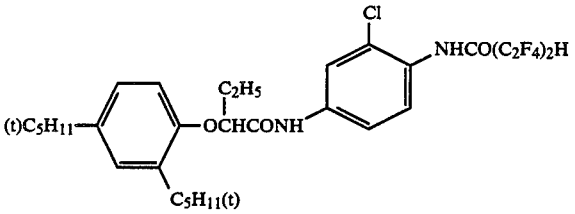

Two or more kinds of the above couplers may be contained in the same layer. It is also possible to contain the same compound in two or more different layers.

The method for incorporating a coupler in an emulsion layer is known in the art, and this invention may follow the known addition method.

In the emulsion layer of this invention, a non-diffusible compound capable of releasing a diffusible development inhibiting compound through the reaction with the oxidized product of a developing agent (DIR compound) can be added.

As the DIR compound, there may advantageously be employed those disclosed in Japanese Unexamined Patent Publication No. 82,424/1977, U.S. Pat. Nos. 2,327,554, 3,227,554 and 3,615,506, Japanese Patent Publication No. 16,141, Japanese Unexamined Patent Publications Nos. 145,135/1979 and 151,944/1982. Particularly preferable DIR compounds are set forth below.

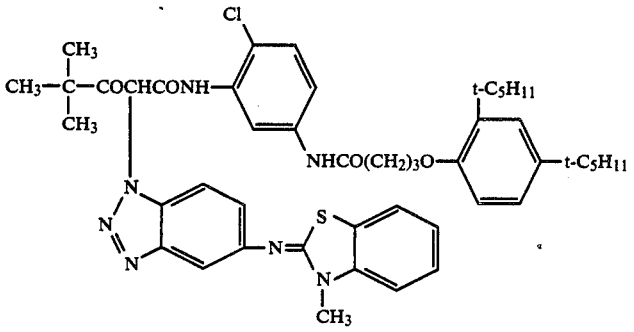

-continued

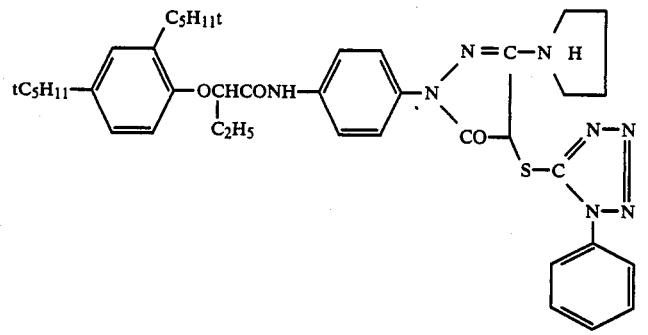

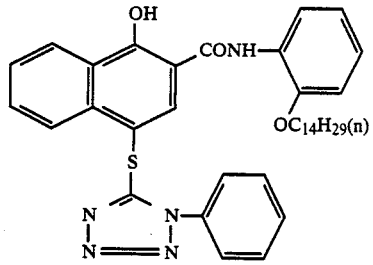

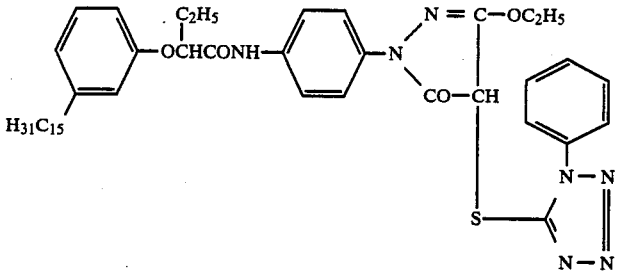

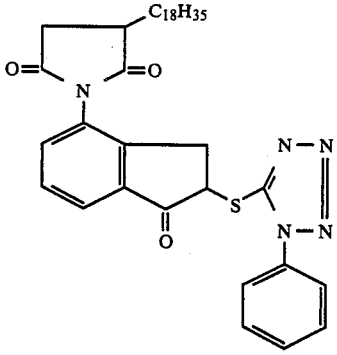

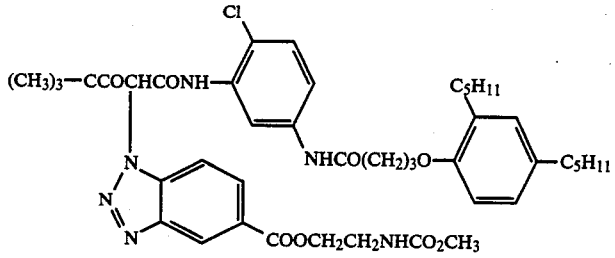

The photographic constitutional layer such as non-light-sensitive intermediate layer of this invention may also contain additives for photography such as staining preventives, etc. As staining preventives, there may be employed compounds as disclosed in Japanese Unexamined Patent Publication No. 2128/1971 and U.S. Pat. No. 2,728,659, particularly preferably the compounds as shown below.

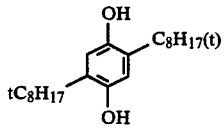

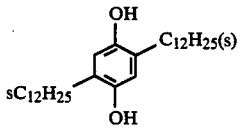

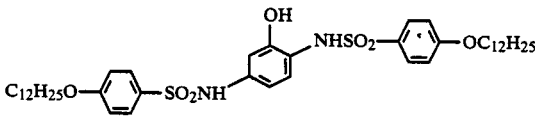

-continued

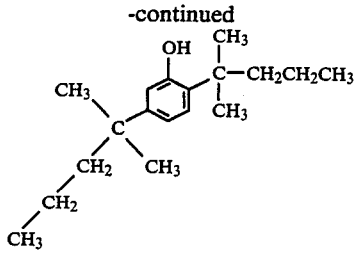

The silver halide emulsion to be used in the emulsion layers of this invention can be chemically sensitized according to any desired method conventionally practiced.

For example, chemical sensitization may be effected by using singly or in combination chemical sensitizers such as noble metal sensitizers, including active gelatin, water-soluble gold salts, water-soluble platinum salts, water-soluble palladium salts, water-soluble rhodium salts, water-soluble iridium salts and the like; sulfur sensitizers; selenium sensitizers; and reducing sensitizers such as polyamines, stannous chloride, etc.

Further, the silver halide may be optically sensitized to a desired wavelength region. For example, it is possible to effect optical sensitization (e.g. ultra-color sensitization) by using singly or in combination cyanine dyes, zeromethyne dyes, monomethyne dyes, dimethyne dyes, trimethyne dyes and the like, or merocyanine dyes.

The light-sensitive material of this invention may also contain various additives depending on the purposes in at least one of the light-sensitive layers and other constituent layers (e.g. intermediate layer, subbing layer, filter layer, protective layer, image receiving layer, etc.).

For example, there are stabilizers or antifoggants such as azaindenes, triazoles, tetrazoles, imidazolium salts, tetrazolium salts, polyhydroxy compounds and the like; film hardeners such as aldehydes, aziridines, isooxazoles, vinyl sulfones, acryloyls, carbodiimides, maleimides, methanesulfonic acid esters, triazines and the like; development accelerators such as benzyl alcohol, polyoxyethylene compounds and the like; image stabilizers such as curomanes, curamanes, bisphenols, sulfite esters and the like; lubricants such as waxes, glycerides of higher fatty acids, higher alcohol esters of higher fatty acids and the like.

Various kinds of surfactants, including anionic, cationic, nonionic or amphoteric type may also be available for various purposes such as coating aids, emulsifiers, penetrability enhancers for processing liquors, defoaming agents or as materials for controlling various physical properties of the light-sensitive material.

As the mordant, N-guanylhydrazone compounds and quaternary onium salt compounds may effectively be used.

As the antistatic agent, there may effectively be used diacetyl cellulose, styrene-perfluoroalkyllithium maleate copolymer, alkali salts of the reaction product of styrene-maleic anhydride copolymer with p-aminobenzenesulfonic acid.

As preventives against color turbidity, polymers containing vinylpyrrolidone monomer and polymers containing vinylimidazole monomer may be employed. As matting agents, polymethyl methacrylate, polystyrene and alkali-soluble polymers may be included. Further, colloidal silicon oxide may also be available.

Latexes to be added for improvement of physical properties of the film may include copolymers of acrylic acid ester or vinyl ester with other monomers having ethylenic groups.

Gelatin plasticizers may include glycerine and glycolic compounds and, as thickeners, there may be employed styrene-sodium maleate copolymers, alkyl vinyl ether-maleic acid copolymers, etc.

The light-sensitive material of this invention may be prepared by providing silver halide emulsion layers and other constituent layers, containing optionally various additives for photography as described above if desired, on a support by way of coating. The support advantageously employed may be, for example, baryta paper, polyethylene-coated paper, polypropylene synthetic paper, glass paper, cellulose acetate, cellulose nitrate, polyvinylacetal, polypropylene, polyester films such as polyethyleneterephthalate, polystyrene and others. These supports are chosen suitably depending on the purposes of uses.

These supports may be applied with subbing treatment, if necessary.

The light-sensitive material of this invention may be subjected to developing processing in a conventional manner after exposure. That is, it can be color developed according to the color developing method conventionally used.

According to the reversal method, development is conducted first by a black-and-white nega developer, then applied with a white color exposure or processed with a bath containing a foggant, and further subjected to color developing with an alkali developer containing a color developing agent.

Processing methods are not particularly limited, but all the processing methods may be applicable. Typically, there may be included the system wherein bleach-fixing processing is conducted after color development, followed further by washing with water and stabilizing processing, if desired or the system wherein bleaching and fixing are conducted separately after color development, followed further by washing with water and stabilizing processing, if desired.

It is also known to process the light-sensitive material with the use of an amplifier agent such as hydrogen peroxide, a cobalt complex, etc., and processings by using these systems may also be possible.

These processings may sometimes be conducted at higher temperatures for the purpose of rapid processing, or alternatively at room temperature or, in special cases, at lower temperatures. In practicing rapid processing at higher temperatures, pre-hardening of films may also be effected.

Depending on the kinds of the processing agents employed, various kinds of auxiliary baths such as neutralizing baths may sometimes be required to be used, and such auxiliary baths may also be available as desired.

Useful color developing agents may include primary phenylenediamines and derivatives thereof, and typical examples are set forth below:

4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylanililne, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, and salts of these such as sulfates, hydrochlorides, sulfites, p-toluenesulfonates, etc.

According to this invention, in addition to sensitization at the leg portion sensitivity (Dmin+0.1) of the characteristic curve, sensitivity at Dmin+(0.4 to 0.8) is improved to a great extent to give a light-sensitive material of extremely high sensitivity. The linearity of gradation is also very good. This may be considered to be probably due to decreased inhibiting action as the result of capture of development inhibitors such as halogens diffused from the upper layer side during development of fine grains of a silver halide.

Also, differs from the cases of other layer constitutions, because of the presence of fine grains of a silver halide, an additional effect as in improvement of graininess to a great extent, which cannot be expected from the prior art.

Further, when a blue-sensitive sensitizing dye is adsorbed on the fine grains of a silver halide, in addition to the above effects, sharpness was found to be improved to a great extent. Such an effect is considered to be due to the filter effect of the blue-sensitive sensitizing dye absorbed on the fine grains of a silver halide.

This invention is described in further detail by referring to the following Examples.

In all the following Examples, the amounts of substances added in the light-sensitive material are indicated per 1 $m^2$. Silver halides and colloidal silvers are calculated as silver.

EXAMPLE 1

According to the layer constitutions shown in Table 1, multi-layer color film samples No. 1 to No. 9 were prepared by providing layers on support having a halation preventive layer provided thereon.

In Table 1, B, G, R, H and L have the same meanings as mentioned above, I indicates an intermediate layer, Y a yellow filter layer, Pr a protective layer and Base a support. AgX' means fine grains of a silver halide.

Further, the asterisk * affixed to BH, GH and RH means that all the light-sensitive silver iodobromide emulsions contained in the respective layers consist of mono-dispersed emulsions.

TABLE 1

| | Sample No.: | | | | | | | | |
|---|---|---|---|---|---|---|---|---|---|
| | 1 (Control) | 2 (Control) | 3 | 4 | 5 | 6 | 7 | 8 | 9 |
| Upper layer | Pr | Pr | Pr | Pr | Pr | Pr | Pr | Pr | Pr |
| | BH | BH | BH | BH | BH | BH | BH | BH | BH* |
| ↑ | BL | I | I | I | I | I | I | I | I |
| ↑ | Y | GH | GH | GH | GH | GH | GH | RH | GH* |
| ↑ | GH | I | I | I | I | I | I | I | I |
| ↑ | I | RH | RH | RH | RH | RH | RH | GH | RH* |
| ↑ | GL | I | I + AgX' | I | I | I | I | I | I |
| ↑ | I | BL | BL | BL + AgX' | BL | BL + AgX' | BL | BL + AgX' | BL + AgX' |
| ↑ | RH | I | I | I | I + AgX' | I + AgX' | I | I | I |
| | I | GL | GL | GL | GL | GL | GL + AgX' | GL | GL |
| | RL | I | I | I | I | I | I | I | I |
| | Base | RL | RL | RL | RL | RL | RL | RL | RL |
| | | Base | Base | Base | Base | Base | Base | Base | Base |

The respective layers are as described below.

RL

A low sensitivity red-sensitive emulsion layer comprising:

0.70 g of an emulsion (Emulsion I) having mean grain size of 0.83μ, consisting of AgBrI having a coefficient of fluctuation $\sigma/\bar{r}$ of 0.35 and containing 6 mole % of AgI, which emulsion has been color sensitized to red-sensitive;

0.7 g of an emulsion (Emulsion II) having mean grain size of 0.83μ, consisting of AgBrI having a coefficient of fluctuation $\sigma/\bar{r}$ of 0.29 and containing 6 mole % of AgI, which emulsion has been color sensitized to red-sensitive; and 2.2 g of gelatin, and also containing:

1.0 g of 1-hydroxy-4-(β-methoxyethylaminocarbonylmethoxy)-N-[δ-(2,4-di-t-amylphenoxy)butyl]-2-naphthoamide (C−1);

0.075 g of 1-hydroxy-4-[4-(1-hydroxy-δ-acetamido-3,6-disulfo-2-naphthylazo)phenoxy]-N-[δ-(2,4-di-t-amylphenoxy)butyl-2-naphthoamide disodium (CC−1);

0.01 g of 1-hydroxy-2-[δ-(2,4-di-t-amylphenoxy)-n-butyl]naphthoamide (C−2); and 0.8 g of tricresyl phosphate (TCP) containing 0.07 g of 2-bromo-4-(2,2,3,3,4,4,5,5,6,6,7,7,8,8,9,9-hexadecafluorononanoylamino)-7-nitro-2-(1-phenyl-5-tetrazolylthio)-1-indanone (D−1) therein.

RH

A high sensitivity red-sensitive emulsion layer comprising:

1.5 g of the silver iodobromide emulsion (Emulsion I) having mean grain size of 0.83μ and color sensitized to red-sensitive; and 1.2 g of gelatin, and also containing;

0.26 g of the cyan coupler (C−1); and 0.30 g of TCP containing 0.03 g of the colored cyan coupler (CC−1) therein.

GL

A low sensitivity green-sensitive emulsion layer comprising:

0.70 g of an emulsion (Emulsion III) having mean grain size of 0.83μ, consisting of AgBrI having a coefficient of fluctuation $\sigma/\bar{r}$ of 0.33 and containing 6 mole % of AgI, which emulsion has been color sensitized to green-sensitive;

0.70 g of Emulsion II color sensitized to green-sensitive; and 2.2 g of gelatin, and also containing:

0.8 g of 1-(2,4,6-trichlorophenyl)-3-[3-(2,4-di-t-amylphenoxyacetamido)benzamido]-5-pyrazolone (M−1);

0.15 g of 1-(2,4,6-trichlorophenyl)-4-(1-naphthylazo)-3-(2-chloro-5-octadecenylsuccinimidoanilino)-5-pyrazolone (CM−1); and 0.95 g of TCP containing 0.012 g of the DIR compound (D−1) dissolved therein.

GH

A high sensitivity green-sensitive emulsion layer comprising:

1.6 g of Emulsion I color sensitized to green-sensitive; and 1.9 g of gelatin, and also containing:

0.20 g of the magenta coupler (M−1); and 0.25 g of TCP containing 0.049 g of the colored magenta coupler (CM−1) therein.

BL

A low sensitivity blue-sensitive emulsion layer comprising:

0.2 g of Emulsion III and 0.3 g of Emulsion II color sensitized to blue-sensitive; and 1.9 g of gelatin, and also containing:

0.6 g of TCP containing 1.5 g of α-pivaloyl-α-(1-benzyl-2-phenyl-3,5-dioxoimidazolidin-4-yl)-2'-chloro-5'-[α-dodecyloxycarbonyl)ethoxycarbonyl]acetanililde (Y−1) dissolved therein.

BH

A high sensitivity blue-sensitive emulsion layer comprising:

0.8 g of Emulsion I color sensitized to blue-sensitive; and 1.5 g of gelatin, and also containing:

1.3 g of TCP containing 1.30 g of the yellow coupler (Y−1) therein.

RH*

GH*

BH*

These were prepared by substituting an emulsion comprising an AgBrI containing 6 mole % of AgI, having a mean grain size of 0.75μ and 0.12 of $\sigma/\bar{r}$ for Emulsions I to III in the above RH, GH and BH, respectively.

I

An intermediate layer containing:

0.8 g of gelatin; and 2 g of dibutyl phthalate (DBP) containing 0.07 g of 2,5-di-t-octyl hydroquinone (HQ−1) dissolved therein.

Y

A yellow filter layer comprising:

0.15 g of yellow colloidal silver;

0.11 g of DBP containing 0.2 g of the staining preventive (HQ−1) dissolved therein; and 1.5 g of gelatin.

Pr

A protective layer of gelatin.

Fine grains of a silver halide employed comprise an AgBrI having 0.088μ of $\bar{r}$, 0.14 of $\sigma/\bar{r}$ and 2 mole % of AgI and they were added in an amount of 4 mg/dm$^2$ in the respective layers.

Each of the thus prepared samples No. 1–No. 9 was subjected to wedge exposure by using green light, blue light and red light and thereafter processed as follows.

| Processing steps (processing temperature 38° C. | Processing time |
|---|---|
| Color developing | 3 min. 15 sec. |
| Bleaching | 6 min. 30 sec. |
| Washing with water | 3 min. 15 sec. |
| Fixing | 6 min. 30 sec. |
| Washing with water | 3 min. 15 sec. |
| Stabilizing | 1 min. 30 sec. |
| Drying | |

The processing solutions employed in the respective processing steps had the compositions as shown below.

[Color developing solution]

| | |
|---|---|
| 4-Amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Nitrilotriacetic acid.3 sodium salt (monohydrate) | 2.5 g |

-continued

| | |
|---|---|
| Potassium hydroxide | 1.0 g |

Make up to one liter by addition of water.

[Bleaching solution]

| | |
|---|---|
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |

Make up to one liter by addition of water, and adjust to pH 6.0 with ammonia water.

[Fixing solution]

| | |
|---|---|
| Ammonia thiosulfate | 175.0 g |
| Anhydrous sodium sulfate | 8.5 g |
| Sodium metasulfite | 2.3 g |

Make up to one liter by addition of water, and adjust to pH 6.0 with acetic acid.

[Stabilizing solution]

| | |
|---|---|
| Formalin (37% aqueous solution) | 1.5 ml |
| Konidax (produced by Konishiroku Photo Industry Co.) | 7.5 ml |

Make up to one liter by addition of water.

The $S_1$ sensitivities and RMS values obtained are shown in Table 2.

In this case, $S_1$ sensitivity and $S_2$ sensitivity are represented in terms of the values relative to that of the sample No. 1 of the reciprocals of exposure dosages which give the densities of Dmin+0.1 and Dmin+0.5, respectively, when the minimum density is defined as Dmin.

On the other hand, RMS is a measure of graininess and it is the standard deviation of fluctuation in density values which occur during scanning by means of a microdensitometer with a scanning orifice diamter of 25μ at a density of Dmin+0.1. Graininess is better as this value is smaller.

These values are shown in Table 2 for blue light (B), green light (G) and red light (R), respectively.

TABLE 2

| | | Sample No. | | | | | | | | |
|---|---|---|---|---|---|---|---|---|---|---|
| Light used | Characteristic values | 1 (Control) | 2 (Control) | 3 | 4 | 5 | 6 | 7 | 8 | 9 |
| B | $S_1$ sensitivity | 100 | 100 | 102 | 101 | 99 | 101 | 102 | 102 | 131 |
| | $S_2$ sensitivity | 100 | 90 | 110 | 109 | 108 | 107 | 107 | 107 | 130 |
| | RMS | 43 | 44 | 39 | 37 | 37 | 37 | 39 | 38 | 33 |
| G | $S_1$ sensitivity | 100 | 117 | 119 | 116 | 117 | 117 | 118 | 116 | 168 |
| | $S_2$ sensitivity | 100 | 92 | 111 | 114 | 113 | 107 | 107 | 111 | 162 |
| | RMS | 31 | 30 | 26 | 24 | 24 | 24 | 24 | 26 | 20 |
| R | $S_1$ sensitivity | 100 | 119 | 120 | 118 | 118 | 118 | 121 | 122 | 182 |
| | $S_2$ sensitivity | 100 | 92 | 106 | 105 | 108 | 108 | 109 | 106 | 180 |
| | RMS | 35 | 34 | 30 | 30 | 28 | 28 | 29 | 30 | 26 |

From the results shown in Table 2, it can be seen that very good values can be obtained for all of $S_1$, $S_2$ and RMS in the light-sensitive materials of this invention (samples Nos. 3 to 9). Further, it can also be appreciated that a very great effect can be obtained in the case as in the sample No. 9, when all the high sensitivity layers contain mono-dispersed emulsions.

In particular, it can be appreciated that particularly great effects of improvement are attained in the sample No. 19.

TABLE 4

| Light used | Characteristic values | Sample No. 10 (Control) | 11 | 12 | 13 | 14 | 15 | 16 | 17 | 18 | 19 |
|---|---|---|---|---|---|---|---|---|---|---|---|
| B | $S_1$ sensitivity | 100 | 102 | 101 | 99 | 98 | 100 | 100 | 100 | 98 | 129 |
| | $S_2$ sensitivity | 100 | 121 | 120 | 109 | 119 | 118 | 107 | 115 | 106 | 128 |
| | RMS | 44 | 39 | 37 | 37 | 43 | 39 | 37 | 38 | 37 | 33 |
| | MTF | 69 | 63 | 62 | 62 | 72 | 76 | 78 | 78 | 79 | 84 |
| G | $S_1$ sensitivity | 100 | 102 | 99 | 100 | 100 | 99 | 98 | 93 | 99 | 164 |
| | $S_2$ sensitivity | 100 | 119 | 122 | 121 | 117 | 120 | 120 | 118 | 120 | 158 |
| | RMS | 30 | 26 | 24 | 24 | 31 | 27 | 24 | 27 | 26 | 22 |
| | MTF | 55 | 50 | 51 | 51 | 59 | 60 | 54 | 59 | 60 | 66 |
| R | $S_1$ sensitivity | 100 | 100 | 101 | 99 | 100 | 100 | 98 | 101 | 99 | 175 |
| | $S_2$ sensitivity | 100 | 114 | 113 | 116 | 113 | 111 | 114 | 112 | 112 | 174 |
| | RMS | 34 | 30 | 30 | 28 | 30 | 30 | 28 | 31 | 29 | 27 |
| | MTF | 40 | 32 | 33 | 31 | 43 | 43 | 45 | 43 | 44 | 48 |

EXAMPLE 2

According to the layer constitutions shown in Table 3, multi-layer color film samples No. 10–No. 18 were prepared by providing layers on support having a halation preventive layer provided thereon.

In Table 3, all the symbols have the same meanings as in Table 1, except that BD means a blue-sensitive sensitizing dye. The respective layers have the same compositions as used in Example 1, except that the blue-sensitive sensitizing dye employed was BD-8, which was used in an amount of 600 mg per 1 mole of the silver halide and added in the respective layers in an amount of 5 mg/dm$^2$.

TABLE 3

| | Sample No.: 10 (Control) | 11 | 12 | 13 | 14 | 15 | 16 | 17 | 18 | 19 |
|---|---|---|---|---|---|---|---|---|---|---|
| Upper layer | Pr | Pr | Pr | Pr | Pr | Pr | Pr | Pr | Pr | Pr |
| | BH | BH | BH | BH | BH | BH | BH | BH | BH | BH* |
| | I | I | I | I | I | I | I | I | I | I |
| | GH | GH | GH | GH | GH | GH | GH | RH | GH | GH* |
| | I | I | I | I | I | I | I | I | I | I |
| | RH | RH | RH | RH | RH | RH | RH | GH | RH | RH* |
| | I | I + AgX' | I | I | I + AgX' + BD | I | I | I | I | I |
| | BL | BL | BL + AgX' | BL | BL | BL + AgX' + BD | BL | BL | BL + AgX' + BD | BL + AgX' + BD |
| | I | I | I | I + AgX' | I | I | I + AgX' + BD | I + AgX' + BD | I + AgX' + BD | I |
| | GL | GL | GL | GL | GL | GL | GL | GL | GL | GL |
| | RL | RL | RL | RL | RL | RL | RL | RL | RL | RL |
| | Base | Base | Base | Base | Base | Base | Base | Base | Base | Base |

The thus prepaed samples 10 to 19 were subjected to wedge exposure with the use of blue light, green light and red light and thereafter processed similarly as described in Example 1.

$S_1$ and $S_2$ sensitivities, and RMS were measured similarly as described in Example 1 to obtain the values as shown in Table 4.

Further, MTF (Modulation Transfer Function) was determined for each sample and the value at a space frequency number of 30 cycle/mm was determined. Sharpness is better as this value is greater.

From the results shown in Table 4, it can be seen that good values of all $S_1$, $S_2$, RMS and MTF can be obained in the sensitive materials of this invention according to the preferred embodiments.

What is claimed is:

1. A light-sensitive silver halide photographic material comprising at least one layer of green-sensitive silver halide emulsion layer, at least one layer of red-sensitive silver halide emulsion layer and a plural number of blue-sensitive silver halide emulsion layers with different sensitivities, provided on a support, wherein one of the said plural number of blue-sensitive silver halide emulsion layers is provided as a silver halide emulsion layer positioned at the farthest side from the support, at least one layer of green-sensitive silver halide emulsion and at least one layer of red-sensitive silver halide emulsion are provided between the said blue-sensitive silver halide emulsion layer and a blue-sensitive silver halide emulsion layer lower in sensitivity than the said blue-sensitive silver halide emulsion layer, and further fine grains of silver halide are contained in at least one of the said blue-sensitive emulsion layer of lower sensitivity and a layer adjacent thereto which fine grains of silver halide have a mean grain size of 0.2$\mu$ or less and are substantially non-light-sensitive.

2. The light-sensitive silver halide photographic material according to claim 1, wherein said fine grains of silver halide are contained in at least one of said blue-sensitive emulsion layer of lower sensitivity and at least one of adjacent layers including the first and the second layers next to the blue-sensitive emulsion layer of lower sensitivity.

3. The light-sensitive silver halide photographic material according to claim 2, wherein said fine grains of silver halide are contained in at least one of said blue-sensitive emulsion layer of lower sensitivity and an intermediate layer adjacent to and upper than the blue-sensitive layer of lower sensitivity or an intermediate layer or a green-sensitive or red-sensitive layer lower in sensitivity than the green-sensitive silver halide emulsion layer or the red-sensitive silver halide emulsion layer provided between the blue-sensitive silver halide emulsion layer positioned on the farthest side from the support and the blue-sensitive silver halide emulsion layer of lower sensitivity, positioned as the first layer or the second layer beneath the blue-sensitive layer of lower sensitivity.

4. The light-sensitive silver halide photographic material according to claim 3, wherein said fine grains of silver halide are contained in at least one of said blue-sensitive emulsion layer of lower sensitivity and the intermediate layer adjacent to and beneath the blue-sensitive layer of lower sensitivity.

5. The light-sensitive silver halide photographic material according to claim 3, wherein said fine grains of silver halide are contained in at least one of the intermediate layer adjacent to and upper than the blue-sensitive layer of lower sensitivity and the green-sensitive layer or the red-sensitive layer positioned below the blue-sensitive layer of lower sensitivity.

6. The light-sensitive silver halide photographic material according to claim 1, wherein said fine grains of silver halide have a mean grain size of 0.03 to 0.15μ.

7. The light-sensitive silver halide photographic material according to claim 1, wherein said fine grains of silver halide are contained in an amount of 2 to 20 mg/dm$^2$ as the silver quantity to be coated.

8. The light-sensitive silver halide photographic material according to claim 1, wherein said fine grains of silver halide are contained in an amount of 1 to 20 mg/dm$^2$ as the silver quantity to be coated.

9. The light-sensitive silver halide photographic material according to claim 1, wherein said fine grains of silver halide are mono-dispersed with a coefficient of fluctuation of 0.2 or less.

10. The light-sensitive silver halide photographic material according to claim 1, wherein said fine grains of silver halide have a blue-sensitive sensitizing dye adsorbed on the surfaces thereof.

11. The light-sensitive silver halide photographic material according to claim 1, wherein said blue-sensitive sensitizing dye is represented by the following formula [I], [II] or [III]:

Formula [I]

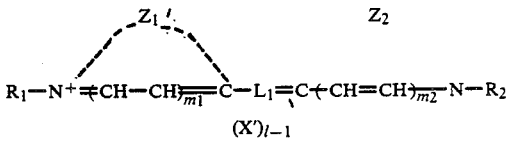

Formula [II]

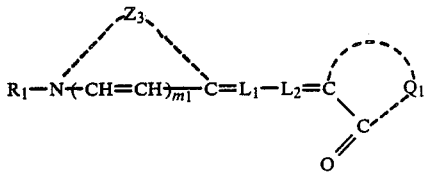

Formula [III]

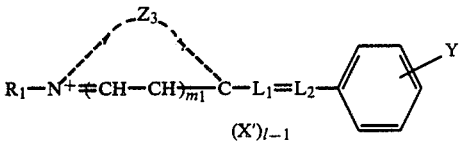

wherein $R_1$, $R_2$ and $R_3$ each represents an alkyl group, a substituted alkyl group or an aryl group; $L_1$ and $L_2$ each represent a methynyl group or a substituted methynyl group; $Z_1$, $Z_2$ and $Z_3$ each represents an atom or a group of atoms necessary for completion of a hetero ring selected from the group consisting of thiazoline, oxazoline, selenazoline, thiazole, oxazole, selenazole, benzoimidazole, indolenine, thienothiazole, thiadiazole, oxadiazole, pyridine and quinoline; $Q_1$ represents a group of atoms necessary for formation of a ring selected from the group consisting of oxazolone, isooxazolone, pyrazolone, oxyindole, barbitur, thiobarbitur, oxazolidinedione, thiazolidinedione, imidazolidinedione, thiooxazolidinedione, thiothiazolidinedione, thioselenazolidinedione, thiohydantoin, oxazolinone, thiazolinone and imidazolinone; Y represents a hydrogen atom, an amino group, a substituted amino group, a halogen, an alkoxy group or an alkyl group; $m_1$ and $m_2$ each are 0 or 1, provided that the total of $m_1$ and $m_2$ is 0 or 1; X is an acid anion group.

12. The light-sensitive silver halide photographic material according to claim 1, wherein said blue-sensitive layer positioned at the farthest side from the support has the difference in sensitivity from the blue-sensitive layer of lower sensitivity, of $\Delta \log E = 0.2$ to 1.0.

13. The light-sensitive silver halide photographic material according to claim 3, wherein each of said green-sensitive and red-sensitive layers has a lower sensitivity than that of the green-sensitive and red-sensitive layers interposed between the blue-sensitive silver halide emulsion layer positioned at the farthest side from the support and the blue-sensitive layer of lower sensitivity, with the difference in sensitivity of from about $\Delta \log E = 0.2$ to 1.0.

14. The light-sensitive silver halide photographic material according to claim 1, wherein silver hailde grains in every silver halide emulsion layer are mono-dispersed with a coefficient of fluctuation of 0.2 or less.

* * * * *